US011970826B2

(12) United States Patent
Thompson et al.

(10) Patent No.: US 11,970,826 B2
(45) Date of Patent: Apr. 30, 2024

(54) CRASH CUSHION

(71) Applicant: Trinity Highway Products LLC, Addison, TX (US)

(72) Inventors: Sean Thompson, Elk Grove, CA (US); Patrick Leonhardt, Loomis, CA (US)

(73) Assignee: VALTIR, LLC, Addison, TX (US)

( * ) Notice: Subject to any disclaimer, the term of this patent is extended or adjusted under 35 U.S.C. 154(b) by 442 days.

(21) Appl. No.: 17/337,091

(22) Filed: Jun. 2, 2021

(65) Prior Publication Data

US 2021/0381181 A1 Dec. 9, 2021

Related U.S. Application Data

(60) Provisional application No. 63/035,414, filed on Jun. 5, 2020.

(51) Int. Cl.
*E01F 15/14* (2006.01)

(52) U.S. Cl.
CPC ..... *E01F 15/143* (2013.01); *E01F 15/146* (2013.01)

(58) Field of Classification Search
CPC . E01F 15/025; E01F 15/0423; E01F 15/0461; E01F 15/0438; E01F 15/143; E01F 15/146; E01F 15/083
See application file for complete search history.

(56) References Cited

U.S. PATENT DOCUMENTS 398,078 A 2/1889 Peterson
1,335,302 A 3/1920 Stout
3,451,319 A 6/1969 Gubela
3,519,301 A 7/1970 Somnitz
3,820,906 A 6/1974 Katt
3,912,404 A 10/1975 Katt
4,071,970 A 2/1978 Strizki
4,126,403 A 11/1978 Sweeney et al.
4,183,695 A 1/1980 Wilcox
4,330,106 A * 5/1982 Chisholm ..... E01F 9/635 256/19

(Continued)

FOREIGN PATENT DOCUMENTS

AU 741450 11/1998
AU 745465 2/1999

(Continued)

OTHER PUBLICATIONS

Brochure—GS Highway Products, Safety Trailers Inc.—TTMA-100, obtained from the Internet on Jun. 27, 2007 at: http://gsihighway.com/safetytrailers.htm, 2 pgs.

(Continued)

*Primary Examiner* — Daniel J Wiley
(74) *Attorney, Agent, or Firm* — Crowell & Moring LLP

(57) ABSTRACT

A crash cushion includes overlapping first and second rail sections coupled with a fastener. The first rail section is moveable relative to the second rail section from a pre-impact position to an impact position in response to an axial impact to the guardrail assembly. The first rail section includes an elongated slot aligned with the fastener and having a first length. A support post is releasably connected to the first rail section and is rotatable to a laid over position after the first rail section has moved a first travel distance, wherein the first length is greater than or equal to the first travel distance.

30 Claims, 9 Drawing Sheets

(56) References Cited

U.S. PATENT DOCUMENTS 4,432,172 A 2/1984 Kuykendall et al.
4,490,062 A 12/1984 Chisholm
4,607,824 A 8/1986 Krage
4,655,434 A * 4/1987 Bronstad ..... E01F 15/143 403/2
4,678,166 A 7/1987 Bronstad et al.
4,784,515 A 11/1988 Krage et al.
4,822,208 A 4/1989 Ivey
4,838,523 A 6/1989 Humble et al.
4,909,661 A 3/1990 Ivey
4,923,319 A 5/1990 Dent
4,928,928 A 5/1990 Buth et al.
5,022,782 A 6/1991 Gertz et al.
5,078,366 A 1/1992 Sicking et al.
5,125,194 A 6/1992 Granger
5,391,016 A 2/1995 Ivey et al.
5,407,298 A * 4/1995 Sicking ..... E01F 15/143 404/6
5,494,371 A 2/1996 Oberth et al.
5,547,309 A * 8/1996 Mak ..... E01F 15/143 404/6
5,577,861 A 11/1996 Oberth et al.
5,642,792 A 7/1997 June
5,657,966 A 8/1997 Cicinnati
5,733,062 A 3/1998 Oberth et al.
5,775,675 A 7/1998 Sicking et al.
5,797,591 A 8/1998 Krage
5,797,592 A 8/1998 Machado
5,823,705 A 10/1998 Jackson et al.
5,868,521 A 2/1999 Oberth et al.
5,924,680 A 7/1999 Sicking et al.
5,947,452 A 9/1999 Albritton
5,957,435 A * 9/1999 Bronstad ..... E01F 15/143 404/6
5,967,497 A 10/1999 Denman et al.
5,988,598 A 11/1999 Sicking et al.
6,036,399 A * 3/2000 Schalk ..... E01F 15/0423 404/9
6,082,926 A 7/2000 Zimmer
6,109,597 A 8/2000 Sicking et al.
6,129,342 A 10/2000 Bronstad
6,142,452 A 11/2000 Denman et al.
6,173,943 B1 1/2001 Welch et al.
6,254,063 B1 7/2001 Rohde et al.
6,293,727 B1 9/2001 Albritton
6,308,809 B1 10/2001 Reid et al.
6,398,192 B1 6/2002 Albritton
6,435,761 B1 8/2002 Bligh et al.
6,457,570 B2 10/2002 Reid et al.
6,461,076 B1 10/2002 Stephens et al.
6,488,268 B1 12/2002 Albritton
6,536,985 B2 3/2003 Albritton
6,536,986 B1 3/2003 Anghileri et al.
6,554,256 B2 4/2003 Ochoa
6,554,529 B2 4/2003 Stephens et al.
6,619,630 B2 9/2003 Albritton
6,623,204 B2 9/2003 Buehler
6,668,989 B2 12/2003 Reid et al.
6,715,735 B2 4/2004 Bligh et al.
6,719,483 B1 4/2004 Welandsson
6,783,116 B2 8/2004 Albritton
6,793,204 B2 9/2004 Albritton
6,811,144 B2 11/2004 Denman et al.
6,843,613 B2 1/2005 Gelfand et al.
6,854,716 B2 2/2005 Bronstad
6,863,467 B2 3/2005 Buehler et al.
6,886,813 B2 5/2005 Albritton
6,902,150 B2 6/2005 Albertson et al.
6,905,281 B2 6/2005 Kang
6,962,459 B2 * 11/2005 Smith ..... E01F 15/146 404/9
7,018,130 B2 3/2006 Smith et al.
7,037,029 B2 5/2006 Buehler et al.
7,059,590 B2 * 6/2006 Bronstad ..... E01F 15/083 256/13.1
7,063,364 B2 6/2006 Bird et al.
7,070,031 B2 7/2006 Smith et al.
7,086,805 B2 8/2006 Smith et al.
7,101,111 B2 9/2006 Albritton
7,112,004 B2 9/2006 Alberson et al.
7,185,882 B2 3/2007 Buth et al.
7,195,419 B2 3/2007 Gelfand
7,210,873 B2 5/2007 Gelfand
7,210,874 B2 5/2007 Albritton
7,246,791 B2 7/2007 Alberson et al.
7,306,397 B2 12/2007 Albritton
7,325,789 B2 2/2008 Buth et al.
7,396,184 B2 7/2008 La Turner et al.
7,484,906 B2 2/2009 La Turner et al.
7,597,501 B2 10/2009 Alberson et al.
7,758,277 B2 7/2010 La Turner et al.
7,794,174 B2 9/2010 McKenney et al.
RE41,988 E 12/2010 Oberth et al.
7,871,220 B2 1/2011 Albritton
7,926,790 B2 4/2011 James
8,215,619 B2 * 7/2012 Leonhardt ..... E01F 15/025 256/13.1
RE43,927 E 1/2013 Buehler
8,360,400 B2 1/2013 Leonhardt et al.
8,414,216 B2 4/2013 Albritton
8,469,626 B2 6/2013 Thompson et al.
8,714,866 B2 5/2014 Albritton
8,974,142 B2 3/2015 Buehler et al.
9,051,698 B1 6/2015 Anghileri et al.
9,458,583 B2 10/2016 Albritton
9,611,599 B1 4/2017 Dyke et al.
9,611,601 B1 4/2017 Anghileri et al.
9,725,857 B2 8/2017 Cho
10,501,901 B2 * 12/2019 Anghileri ..... E01F 15/143
11,512,440 B2 * 11/2022 Edl ..... E01F 15/0461
2002/0030183 A1 3/2002 Albritton
2002/0179894 A1 12/2002 Albritton
2003/0175076 A1 9/2003 Albritton
2003/0210954 A1 11/2003 Kang
2004/0016916 A1 * 1/2004 Bronstad ..... E01F 15/146 256/13.1
2006/0011900 A1 * 1/2006 Ochoa ..... E01F 15/0438 256/13.1
2006/0027797 A1 2/2006 Sicking et al.
2006/0038164 A1 2/2006 Sicking et al.
2006/0054876 A1 3/2006 LaTurner et al.
2006/0151986 A1 7/2006 Reid et al.
2007/0016916 A1 1/2007 Shiwa et al.
2007/0140791 A1 6/2007 Gelfand
2007/0237577 A1 10/2007 Gelfand et al.
2008/0075529 A1 3/2008 Gelfand et al.
2008/0160421 A1 7/2008 Hayashida et al.
2008/0181722 A1 7/2008 McKenney et al.
2009/0174200 A1 * 7/2009 LaTurner ..... B60R 19/34 293/133
2010/0243978 A1 * 9/2010 Leonhardt ..... E01F 15/025 256/13.1
2016/0369460 A1 12/2016 Cho
2021/0394695 A1 12/2021 Maus et al.

FOREIGN PATENT DOCUMENTS

AU 747889 5/2000
AU 762805 3/2001
CN 101343863 A 1/2009
EP 0 738 802 A1 3/1996
EP 0 924 347 A1 6/1999
EP 0 994 985 B1 9/2005
GB 2 023 695 A 1/1980
IT MI20072152 A1 5/2009
WO WO 1999/32728 A1 7/1998
WO WO 1998/44203 A1 10/1998
WO WO 1998/50637 A1 11/1998
WO WO 1999/02781 A1 1/1999
WO WO 1999/02782 A1 1/1999
WO WO 2000/26473 A1 5/2000

(56) References Cited

FOREIGN PATENT DOCUMENTS

| | | | |
|---|---|---|---|
| WO | WO 2000/40805 | A1 | 7/2000 |
| WO | WO 2001/14646 | A1 | 3/2001 |
| WO | WO 2007/071725 | A1 | 6/2007 |

OTHER PUBLICATIONS

Brochure—Safety Trailers, Inc.—TTMA in tow no need to stow, use at any speed, obtained on Jun. 12, 2007, 8 pgs.
Brochure—Vägverket—Pocket Facts 2006, Swedish road Administration, Roads and Facts, dated 2006, 52 pgs.
"X-Tension™ Guardrail End Terminal: Step by Step Instructions for the *Tangent, Flared and Median* Applications—Installation and Maintenance Manual," Barrier Systems, Rio Vista, CA 94574, v1, dated May 15, 2008, 36 pages.
Search Report and Written Opinion dated Nov. 5, 2021 for corresponding application No. PCT/US21/35412 (13 pages).
"CAT-350 Crash Cushion Attenuating Terminal Assembly Manual", Trinity Highway Products, Feb. 2005 (12 pages).

* cited by examiner

CRASH CUSHION

This application claims the benefit of U.S. Provisional Application Ser. No. 63/035,414, filed Jun. 5, 2020 and entitled "Crash Cushion," the entire disclosure of which is hereby incorporated herein by reference.

FIELD OF THE INVENTION

The present invention relates generally to a crash cushion, and in particular, to a crash cushion configured with a guardrail to mitigate high energy forces during collapse.

BACKGROUND

Crash cushions, including guardrails with end terminals, may be used alongside highways in front of obstructions such as concrete walls, toll booths, tunnel entrances, bridges and the like so as to protect the drivers of errant vehicles. In some systems, the crash cushion may include a guardrail assembly, for example configured with a guardrail end treatment that is capable of absorbing and distributing an axial impact load. Such guardrail systems may include a plurality of panels configured with slots. During an axial impact, the energy of the moving vehicle is attenuated by way of friction between the panels and by shearing the panel material between the slots. At the same time, these systems may include support posts supporting the panels. The support posts may be configured to break during an axial impact. Finally, some systems include a deforming member that deforms one or more of the panels.

These various systems may have various shortcomings. For example and without limitation, during an axial impact event, while the crash cushion is being impacted by a vehicle, there are several mechanisms for absorbing the energy of the impacting vehicle and generating forces to slow the vehicle down. The impact forces, or energy absorbing mechanisms, include the energy/force required to the break the tabs in the guardrail panels, the energy/force created by friction in the panels, the energy/force to deform a guardrail panel, and the energy/force required to knock over the breakaway support post(s). If all of these forces occur simultaneously, the system may impose higher than desired deceleration forces on the impacting vehicle, for example by a deceleration spike created by the breakaway support post.

For example, the force to knock over the support post(s) is one force that typically may not be spread out over the course of the collapse of an individual bay of the crash cushion. The force to knock over the post(s) is typically high, or spikes, when the post is first impacted, then drops off as the post breaks away from the guardrail. This spike may complicate the design of a crash cushion making use of the various energy dissipation mechanisms, as the total force generated by the four forces may be higher than desired when the post is first impacted.

As such, it may be desirable to provide a system that provides a smoother, or more consistent, deceleration force during the impact event.

SUMMARY

The present invention is defined by the following claims, and nothing in this section should be considered to be a limitation on those claims.

In one aspect, one embodiment of a crash cushion includes a first rail section having an upstream end portion, a downstream end portion and a first side. A second rail section includes an upstream end portion, a downstream end portion and a second side facing the first side of the first rail section. The upstream end portion of the second rail section overlaps with and is secured to the downstream end portion of the first rail section with a fastener. The first rail section is moveable relative to the second rail section from a pre-impact position to an impact position in response to an axial impact to the guardrail assembly. The first rail section includes a plurality of longitudinally spaced slots aligned with and extending upstream of the fastener. The plurality of slots includes a first elongated slot aligned with the fastener when the first rail section is in the pre-impact position, wherein the first elongated slot has a first length. A support post is releasably connected to the first rail section and is rotatable from an upright position to a laid over position. The support post is releasable from the first rail section and is rotatable to the laid over position after the first rail section has moved a first travel distance during the axial impact, wherein the first length is greater than or equal to at least 75%, and more preferably 100%, of the first travel distance.

In another aspect, one embodiment of the crash cushion includes a support post that absorbs a first amount of energy as the support post is rotated to a laid over position. A first adjacent pair of slots are separated by a tab, wherein the fastener engages the tab and absorbs a second amount of energy after the support post absorbs at least 75%, and more preferably 100%, of the first amount of energy.

In another aspect one embodiment of a support post assembly includes a ground anchor and a support post having a front, a rear and opposite sides. The rear includes a pair of vertical slots and a hinge portion defined between the slots. A bottom of the hinge portion and at least one of the front and sides are connected to the ground anchor with welds. The welds connecting the at least one of the front and sides are breakable as the support post is rotatable about the hinge portion from an upright position to a laid over position.

In yet another aspect, one embodiment of a method of absorbing the energy of an impacting vehicle includes impacting an impact head of a crash cushion, sliding first rail section relative to a stationary second rail section from a pre-impact position to an impact position, wherein the first and second rail sections are coupled with a fastener. The method further includes sliding the fastener in a slot defined in the first rail section, wherein the slot has a first length, and rotating a support post connected to the first rail section from an upright position to a laid over position after the first rail section has moved a first travel distance, wherein the first length is greater than or equal to at least 75% of the first travel distance. In one embodiment, the second rail section includes a deforming member secured thereto, and the first rail section has a second elongated slot aligned with the deforming member, wherein the second elongated slot has a second length greater than or equal to at least 75% of the first travel distance.

The various aspects and embodiments provide significant advantages. For example, sizing the slot on the panel such that the deforming member on the stationary panel cannot deform the panel until the support post breaks away accommodates and does not add to the energy spike created by the breakaway force of the support post. Likewise, the spacing of the tabs in the guardrail panels may be configured such that no tabs are sheared until the support post has laid over, or nearly laid over. In addition, portions of the weld securing the support post to the ground anchor may be removed, or minimized, for example along the front, sides or rear, such that a lower force is required to knock the support post over, with a corresponding lessening in the energy absorbed. These various alternative solutions can be used individually or collectively in concert with one or more of the other solutions to achieve the desired results, allowing the user to tune the system.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 4:
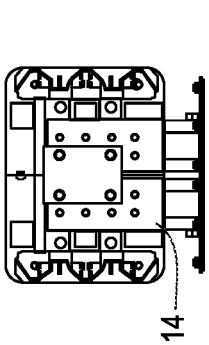
FIG. 4 is rear end view of the crash cushion shown in FIG. 1.
Figure 5:
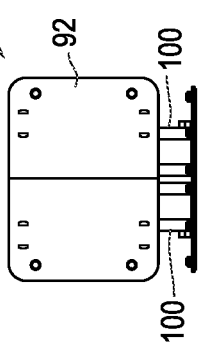
FIG. 5 is a front end view of the crash cushion shown in FIG. 1.
Figure 1:
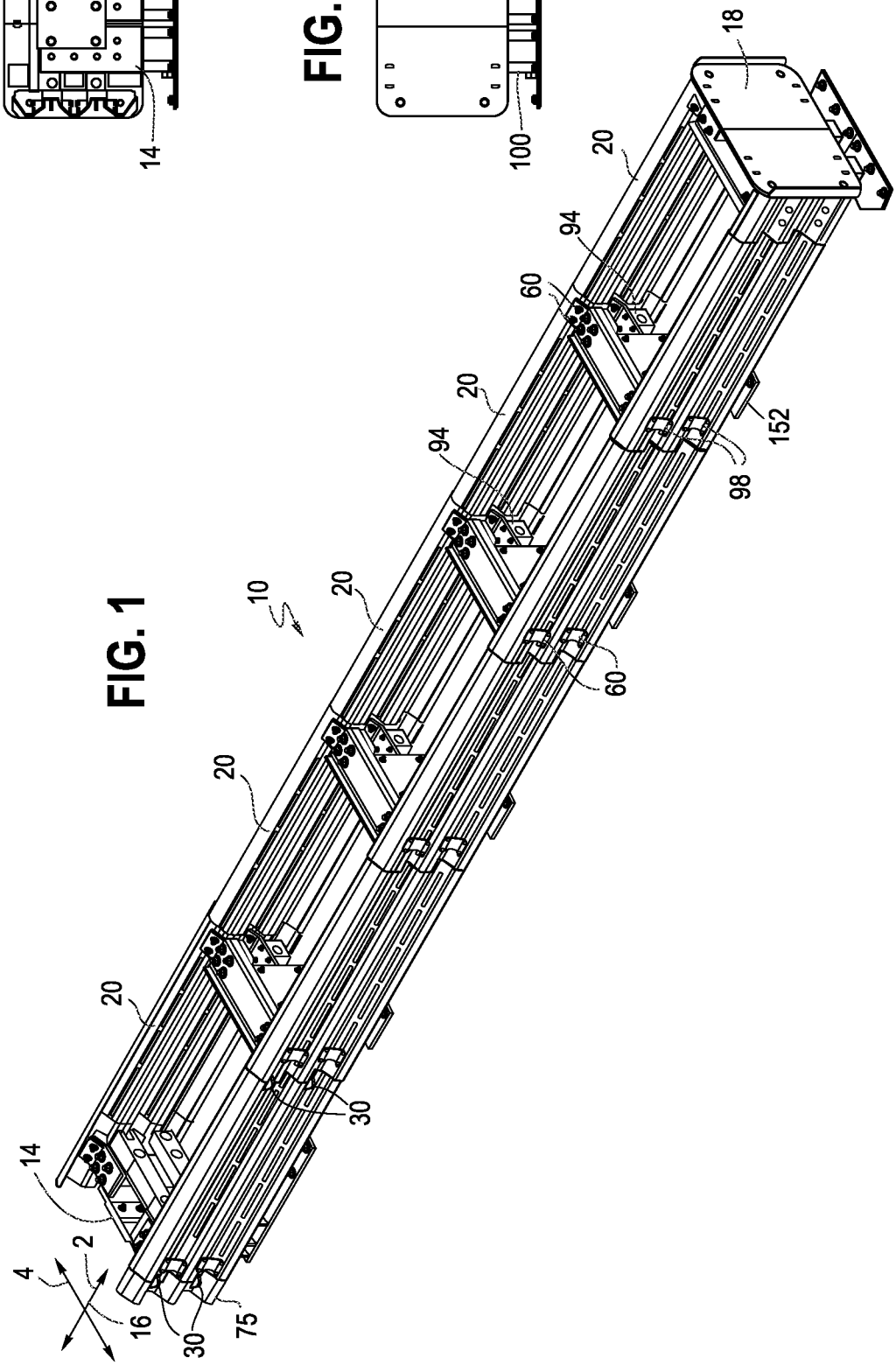
FIG. 1 is a perspective view of one embodiment of a crash cushion.

It should be understood that the term "plurality," as used herein, means two or more. The term "longitudinal," as used herein means of or relating to length or the lengthwise direction 2 of the crash cushion, or assembly thereof, and includes an axial, end-on impact direction. During an end-on impact, the system dissipates the energy of the impacting vehicle as the system collapses. The term "lateral," as used herein, means directed between or toward (or perpendicular to) the side of the crash cushion, for example the lateral direction 4, or a side impact direction. The term "coupled" means connected to or engaged with, whether directly or indirectly, for example with an intervening member, and does not require the engagement to be fixed or permanent, although it may be fixed or permanent, and may include an integral connection wherein the features being coupled are portions of a single, unitary component. The term "transverse" means extending across an axis, and/or substantially perpendicular to an axis. It should be understood that the use of numerical terms "first," "second," "third," etc., as used herein does not refer to any particular sequence or order of components; for example "first" and "second" connector segments may refer to any sequence of such segments, and is not limited to the first and second connector segments of a particular configuration unless otherwise specified. The terms "upstream" and "downstream" refer to directions relative to the impact direction of a vehicle 12, for example with the backup 14 and rear anchor being downstream of the impact head 18, or the front of the crash cushion 10. The terms "inboard" and "outboard" are defined in the lateral direction relative to a centerline longitudinal axis 16, with "inboard" referring to a component or feature being closer to the centerline axis, and "outboard" referring to a component or feature being further from the centerline axis. The phrase "crash cushion" refers to a double sided system, as shown in FIG. 1, and also to a guardrail end terminal system, for example configured with only one side, or half, of the system shown in FIG. 1. The terms "deform," "deforming," and "deformable," and variations thereof, as used herein mean to transform, shape or bend without shearing. The term "overlap" refers to two components, or portions thereof, positioned or lying over or next to each other, and is independent of the lateral position of the overlapping components, with a portion of an upstream rail section "overlapping" a portion of a downstream rail section, and vice versa.

The crash cushion 10 disclosed in FIG. 1 provides a system that smooths out the energy dissipation curve by reducing/eliminating forces applied by shearing fasteners 60 and tabs 26, 28 and/or deforming members 30 during the time interval that one or more support posts 100 are being laid over and absorbing energy. The support post assembly may also be configured to reduce the amount of force to knock or lay over the support post(s). The various embodiments may be incorporated into a crash cushion or end terminal that has overlapping fender panels, or rail sections 20, and absorbs energy by shaping and/or shearing material (e.g., tabs 26, 28) as a first panel slides over a second panel. The system is particularly well suited for a staged crash cushion or end terminal in which only one bay compresses at a time.

Figure 15:
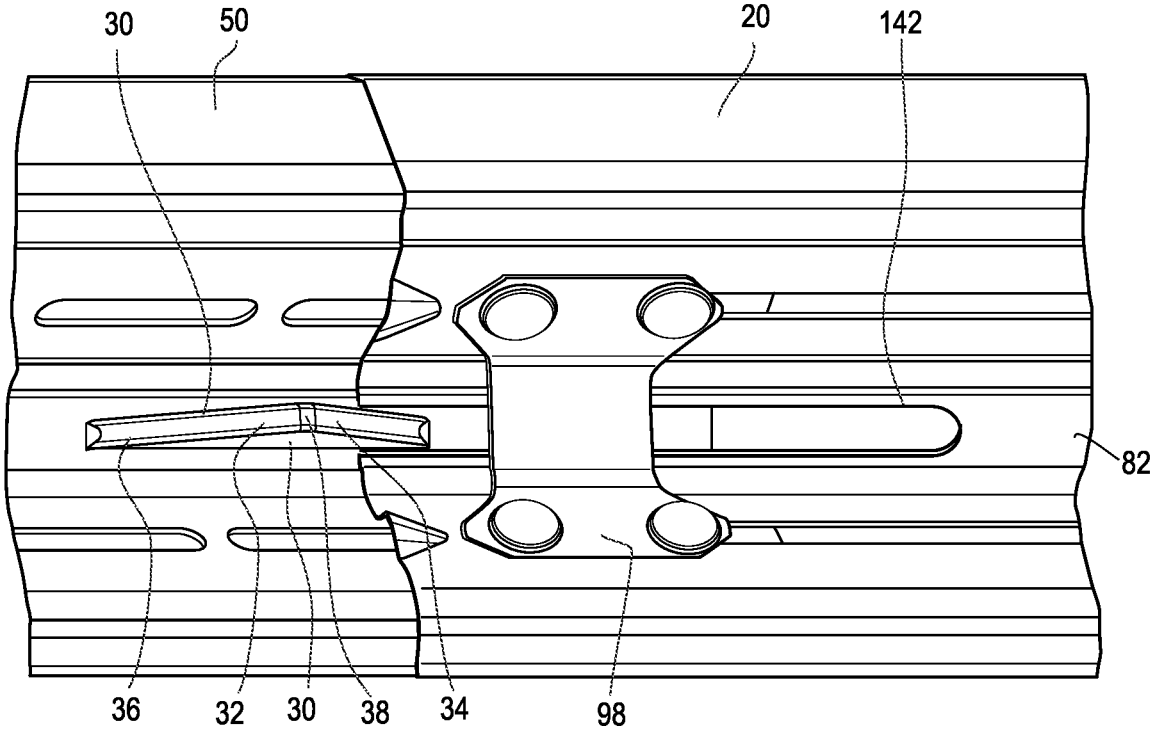
FIG. 15 is a partial side view showing overlapping rail sections including a deforming member.

The crash cushion 10 (FIGS. 1-5) includes of a plurality of guardrail panels, otherwise referred to as rail sections 20 (FIGS. 6 and 7) containing slots 22, 24 and tabs 26, 28. Some of the guardrail panels also include deforming members 30 (FIGS. 7 and 15). The deforming member 30, configured in one embodiment as a shaper fin, provides for a low cost method for increasing the running load of the crash cushion when impacted in the longitudinal direction. In one embodiment, the deforming member 30 is made of metal, for example and without limitation steel. The deforming member has a central portion 32 having oblique leading and trailing edges 34, 36 meeting at a curved apex 38. The deforming member 30 is secured to an upstream end portion 50 of a rail section 20, for example by welding or with fasteners in a valley 82, with the central portion extending laterally outwardly from the rail section as shown in FIG. 15. The deforming member is further described and disclosed in U.S. Pat. No. 8,215,619 the entire disclosure of which is hereby incorporated herein by reference.

In one embodiment, the crash cushion includes a first rail section 20 having an upstream end portion 50, a downstream end portion 52 and a first, inboard side 54. A second rail section 20 includes an upstream end portion 50, a downstream end portion 52 and a second, outboard side 56 facing the first, inboard side 54 of the first rail section. The upstream end portion 50 of the second rail section overlaps with and is secured to the downstream end portion 52 of the first rail section with one or more fastener(s) 60. In one embodiment, the rail sections are coupled with a total of eight (8) fasteners 60 defined by four rows of two (2) longitudinally spaced fasteners.

The first rail section is moveable relative to the second rail section from a pre-impact position to an impact position in response to an axial impact to the guardrail assembly by the vehicle 12 moving along the longitudinal direction 2. It should be understood that the crash cushion may include several bays 70, 72, 74, 76, 78 (shown as 5 in FIGS. 1-3) each defined by a pair of laterally spaced rail sections 20 an upstream diaphragm 132 and a downstream diaphragm 132, with the downstream diaphragm defining an upstream diaphragm of the next adjacent downstream bay. It should be understood that the crash cushion may have more or less than five (5) bays. It also should be understood that the rail sections 20 of an upstream bay are referred to as first rail sections and the rail sections 20 of a next adjacent downstream bay are referred to as the second rail sections. During an axial impact event, the bays collapse sequentially, with the "first" rail sections 20 of the first bay 70 sliding past the "second" rail sections 20 of the second bay 72. Next, the rail sections 20 of the second bay 72 become the "first" rail sections sliding past the "second" rail sections of the third bay 74, and so on, Each rail section 20 includes at least one row of a plurality of longitudinally spaced slots 22, 24 aligned with and extending upstream of the fastener(s) 60. In one embodiment, each rail section includes a plurality (shown as four) vertically spaced rows of slots 22, 24. The plurality of slots in each row includes a first elongated slot 24, positioned at the downstream end portion 52 aligned with the fastener(s) 60 when the first rail section is in a pre-impact position, i.e., before impact of the crash cushion by the vehicle, wherein the shortest first elongated slot 24 has a first minimum length (L1), measured between the location (axis) of the first upstream fastener and the end of the slot 24. The first portion of the first slot may be slightly enlarged to more easily insert and install fasteners 60.

Figure 6:
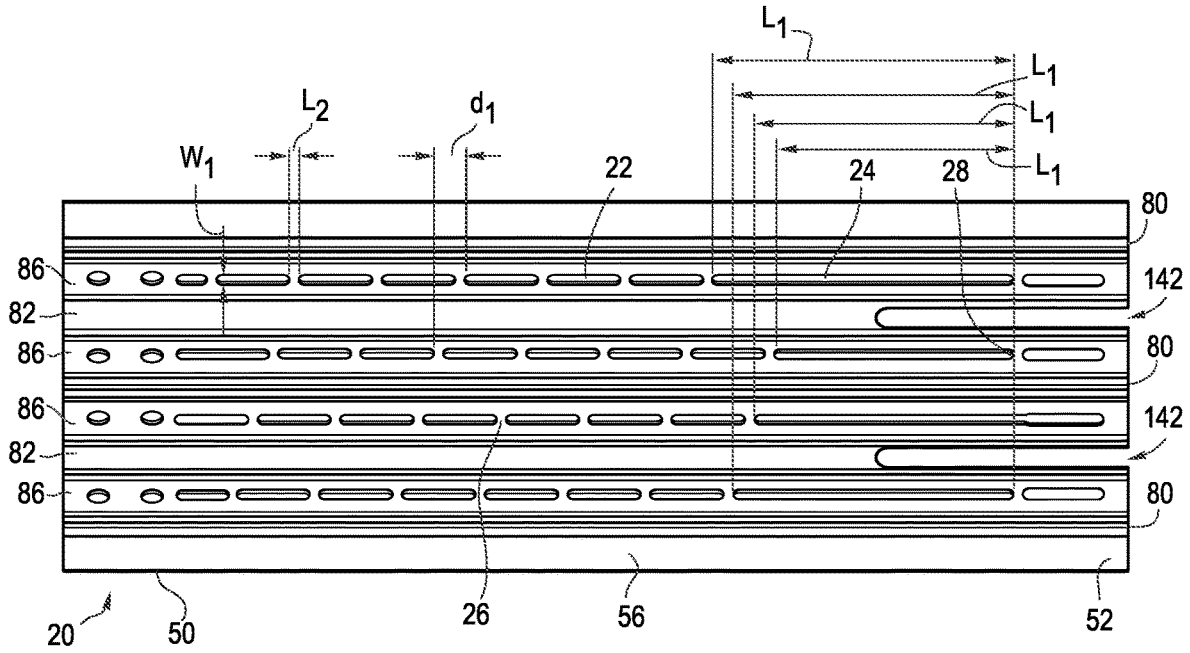
FIG. 6 is a side view of one embodiment of a rail section.
Figure 7:
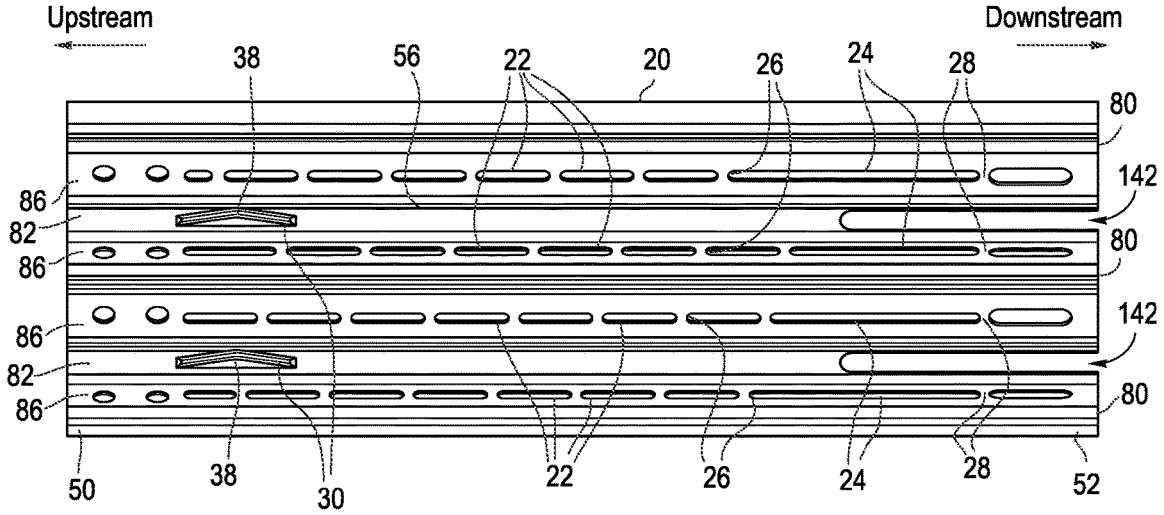
FIG. 7 is a side view of another embodiment of a rail section.

As shown in FIG. 6, each rail section 20, is preferably formed as a Thrie beam having three outwardly extending peaks 80 and two inwardly extending valleys 82, with the rows of slots 22, 24 formed in each of four walls 86 between one of the peaks and valleys. The deforming members 30 are secured to the rail sections in the valleys 82. It should be understood that the rail sections may also be configured as W-shaped beams, which may have two peaks and one valley. The Thrie beams have a greater amount of overlapping surface area, and therefore a greater amount of friction force and energy dissipation during an impact event for an equal amount of clamping force. Preferably, in order to smooth the energy dissipation, the vertically spaced rows of slots are horizontally staggered in the longitudinal direction, such that the slots 22 and tabs 26 in each row are not vertically aligned with the slots 22 and tabs 26 of any other row. The first elongated slots 24 in each row may have different lengths (L1), such that the next upstream slots 22 are staggered relative to the next adjacent rows, for example a distance d1.

Figure 9:
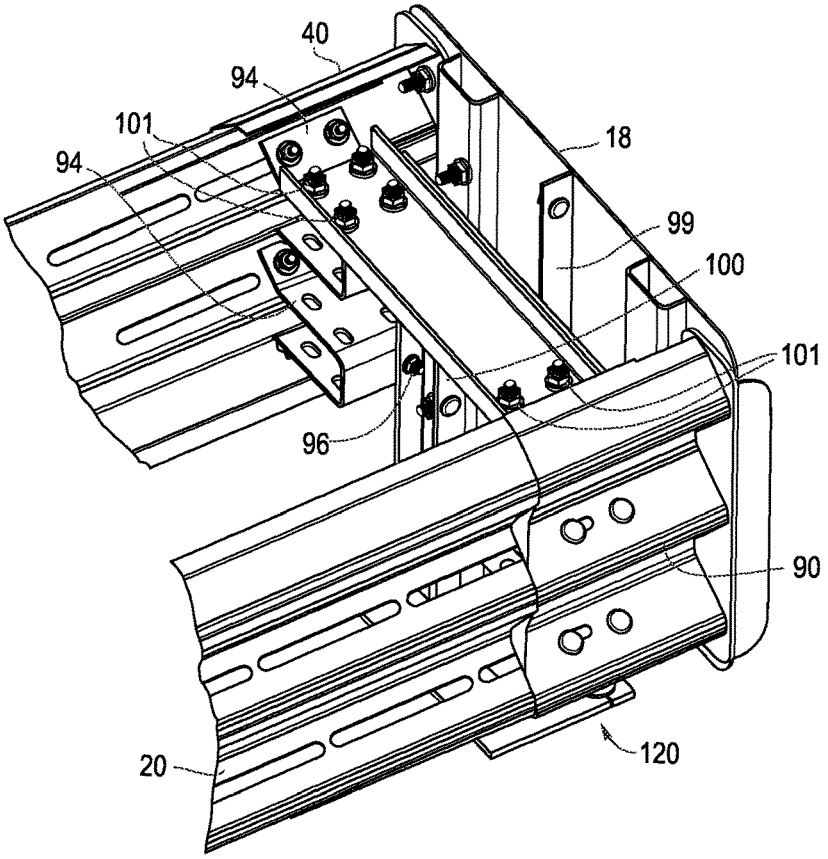
FIG. 9 is a partial perspective view of the impact head mounted to a pair of rail sections.
Figure 11A:
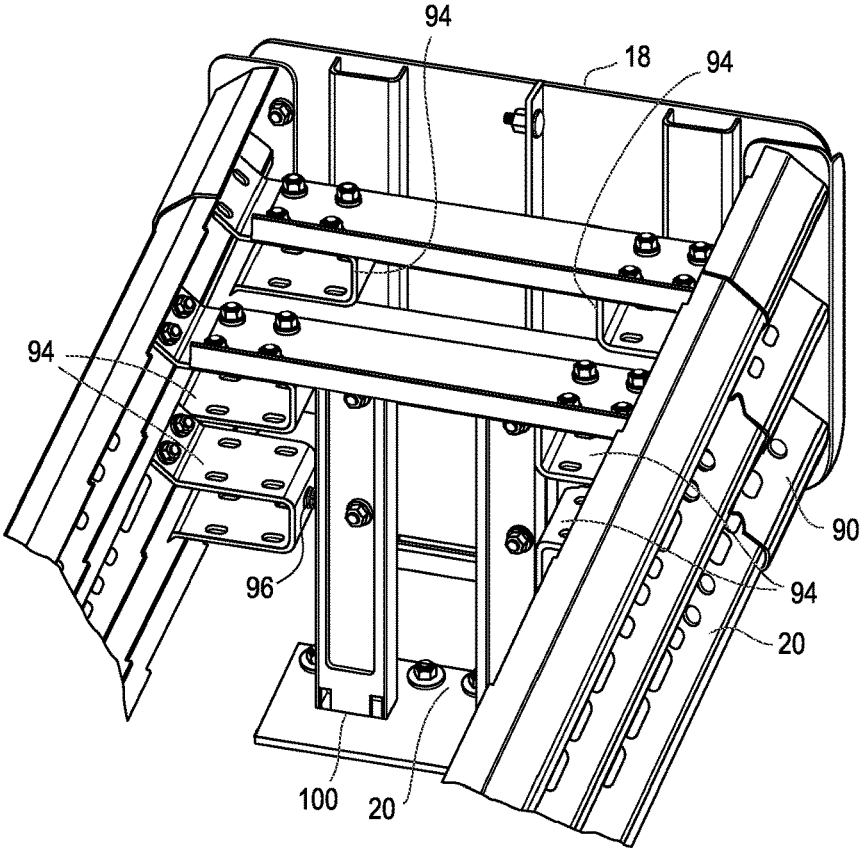
FIG. 11A is a top perspective view of the crash cushion prior to the impact head engaging a downstream diaphragm.
Figure 11B:
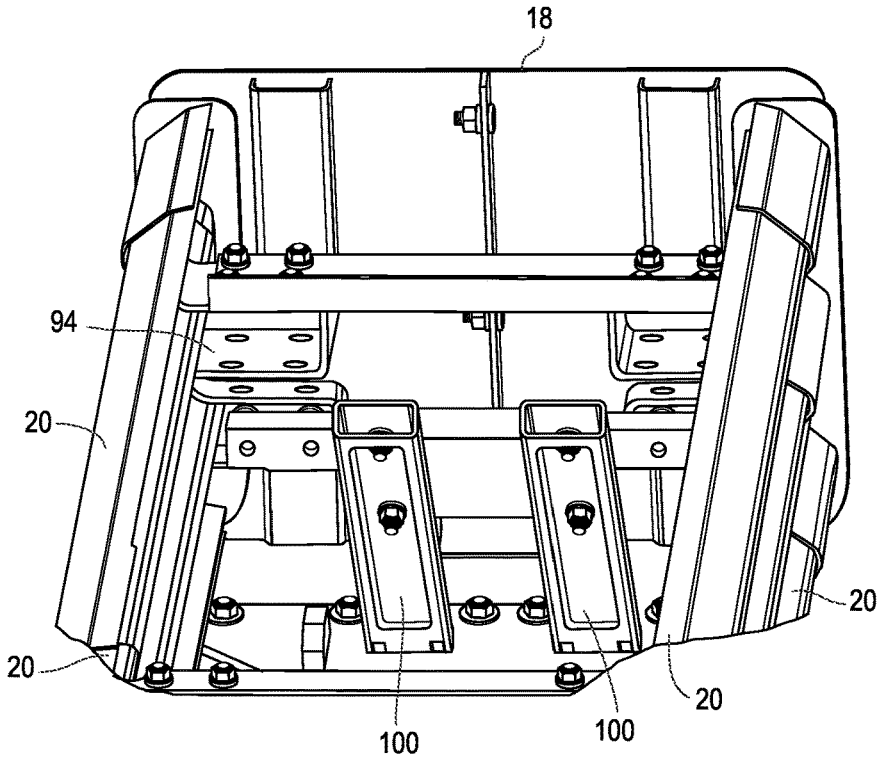
FIG. 11B is a top perspective view of the crash cushion immediately after the impact head engages a downstream diaphragm.

The first guardrail panels, or first rail sections, are attached to a mounting bracket 90 that is attached to an impact head 18, which may include a pair of panels or plates (FIG. 9). When impacted by a vehicle, each successive upstream guardrail panel, or first rail section 20, slides over the downstream guardrail panel, or second rail section 20, in the next bay which remains stationary until the preceding bay is collapsed and the impact head 18 impacts the support posts 100, or diaphragm 132 defined in part thereby, at the front of the next bay. The guardrail panels, or rail sections 20, are attached to spacers 94 that are attached to breakaway support posts 100 with shear fasteners 96. For example, the guardrails (e.g., first rail sections) in the first bay 70 slide over the guardrails (second rail sections) of the second bay 72 (FIGS. 11*a* and *b*). Once that is complete, the guardrails (now first rail sections) of the second bay 72 slide over the guardrails (second rail sections) of the third bay 74. The sliding guardrail panels, or rail sections, are held to the other guardrail panels by bolts, or fasteners 60 that clamp the two rail sections together on each side of the bay, and created friction between the sliding rail sections. A pair of brackets 98 overlie the valleys and two rows of vertically spaced fasteners. In addition, a cross member 99 extends laterally across the top of the diaphragm and has opposite ends connected to the upper spacers 94 with a plurality of fasteners 101. The cross members 99 are not connected to the support posts 100. The cross members may have a Z-shape or L-shape, and may include a lip 103 that bends over the top and front of the support posts, which acts as a stop engaging the support posts and helps prevent the fasteners 60 from shearing until the support posts 100 lay over during an impact event. At the same time, the lip does not interfere with or prevent the support posts/diaphragm from laying over since the cross member is not connected thereto.

Figure 2:
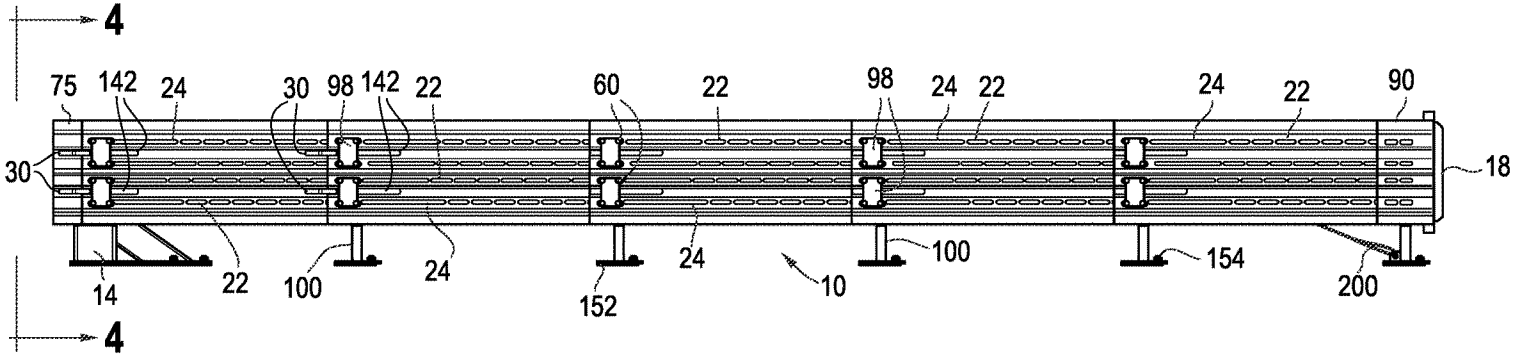
FIG. 2 is a side view of the crash cushion shown in FIG. 1.
Figure 3:
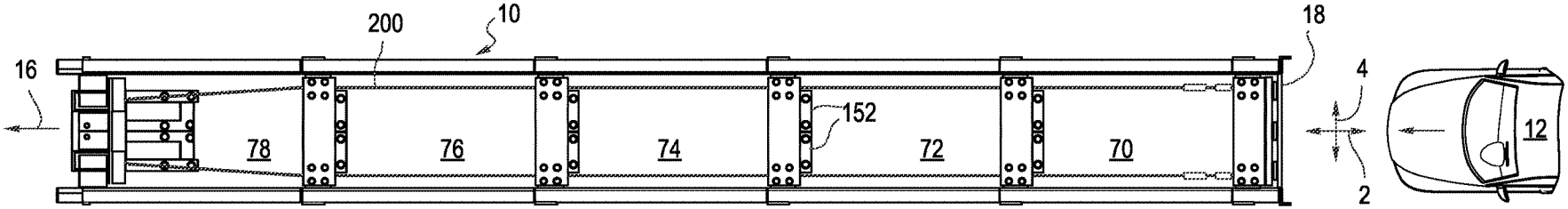
FIG. 3 is a top view of the crash cushion in FIG. 1.
Figure 10:
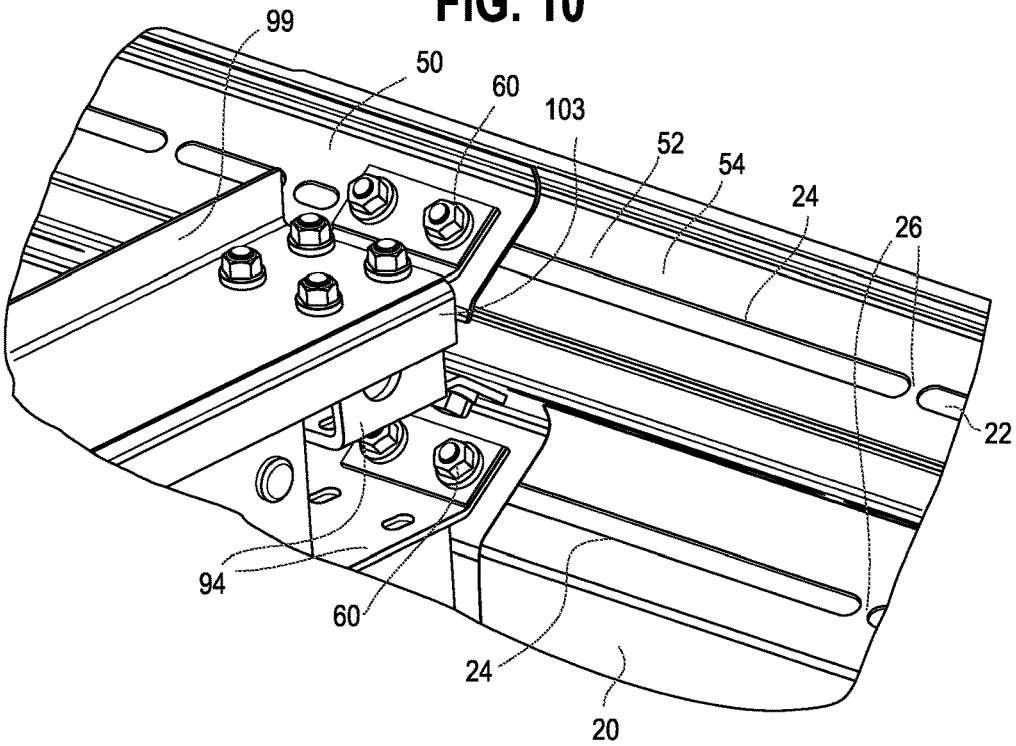
FIG. 10 is a partial perspective view showing the connection of spacers and rail sections, with fasteners securing overlapping end portions of the rail sections.

The fasteners 60 travel through the slots 24, 22 on the sliding guardrail panels as they are pushed forward by the impacting vehicle during an impact event. Longitudinally spaced tabs 26 of material separating the slots 22, 24 are broken or sheared by the fasteners 60 during the impact event, with the fasteners secured to the rails of the downstream bays remaining stationary until each bay is sequentially collapsed (FIGS. 6 and 10). The breaking of the tabs 26 absorbs energy and thus applies force(s) to slow down the movement of the guardrail, or rail section. The tabs 26 are sized such that the force to break them is appropriate for the vehicle that has impacted the crash cushion. Closely spaced tabs 26 create a higher average force and widely spaced tabs a lower average force. A number of other parameters also affect the force generated by the tabs 26, for example the thickness, length, and width of the tabs 26, and whether more than one tab is sheared at a time. In one preferred embodiment, the tabs 26, and also starter tabs 28, have a length (L2) of 0.43 in. and a width (w1) of 0.75 in. The thicknesses of the tabs are 0.135 in., which corresponds to the thickness of the guardrail panels, or rail sections. Other dimensions of the tabs may be suitable. On the guardrail panel(s), or rail section(s) at the front of the system (e.g., bay 70), the tabs 26 are spaced 8.6 inches apart, while on the guardrail panels at the rear (e.g., bays 72, 74, 76, 78), the tabs 26 are spaced 4.1 inches apart. In one embodiment, only one tab is sheared at a time, per panel. This is accomplished by staggering the vertically spaced rows of tabs in each rail in the longitudinal direction, as shown in FIGS. 2, 6 and 7.

Figure 12:
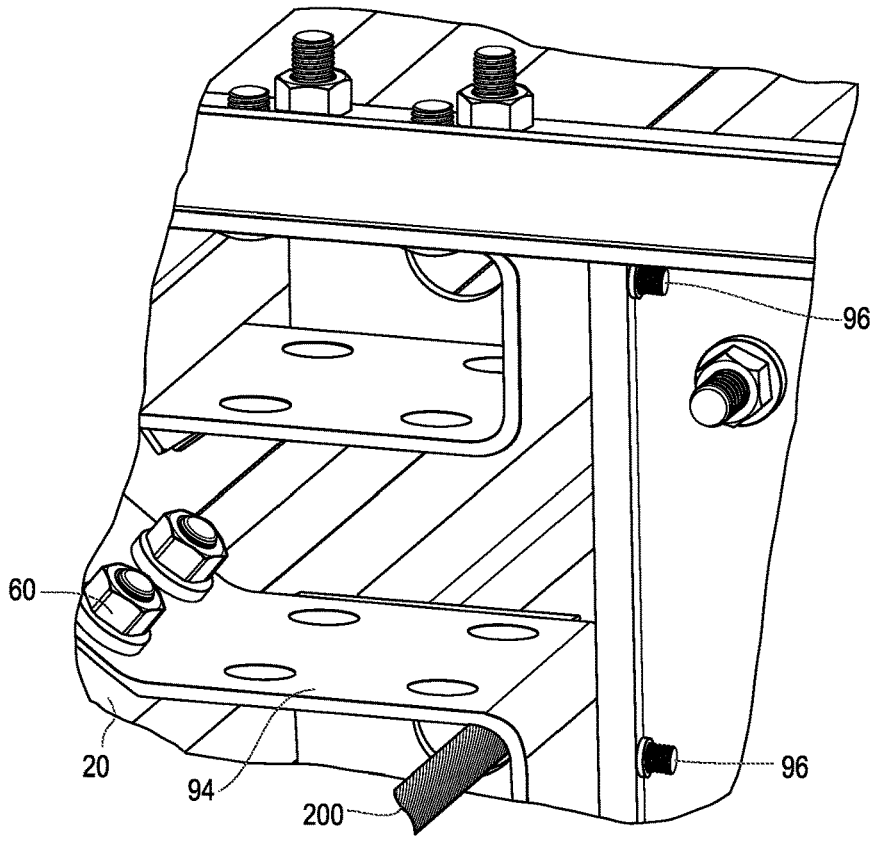
FIG. 12 is an enlarged partial end view showing the connection between a spacer and a support post.

Each sliding guardrail panel, or rail section 20, is clamped to the stationary guardrail panel underneath by the fasteners 60, as disclosed above. The fasteners 60 apply a predefined compression force between the panels. Therefore, the overlying sliding guardrails, or first and second rail sections, experience sliding resistance due to the clamping friction. The clamping force applied by the fasteners 60 (e.g., bolts) is controlled by torqueing the bolts to a predefined value. For example, in a typical crash cushion, the torque may be 33 ft-lbs. Higher and lower values may also be used, for instance, a range of 25 ft-lbs to 130 ft-lbs could be used. The torque of the bolts in each bay (rear or downstream end of the bay) may be the same, but in some instances the torqueing may be different in different bays. For instance, the fasteners at the downstream end of a bay may have higher torques than the fasteners at the upstream end of the bay to ensure that the upstream bays collapse first, and sequentially thereafter. The impacted, sliding guardrails, or rail sections 20, are attached to the spacers 94, which in turn are attached to breakaway support post assemblies by the shear bolts 96 (FIGS. 8 and 12).

In operation, the crash cushion 10 is impacted axially by a vehicle 12 along the longitudinal direction 2 and moves in the direction of travel of the vehicle. The impact head 18 is directly attached to a mounting bracket 90 (FIG. 9), which is directly attached to the rail sections 20, or panels, of the first bay 70 (FIGS. 1 and 9). The mounting bracket 90 and first bay panels, or first rail sections 20, are attached to spacers 94 coupled to a first pair of support post assemblies 120 connected to the mounting bracket 90 and impact head 18. The spacers 94 are connected to the first pair of breakaway posts 100 by the shear bolts 96. The first bay panels, or first rail sections, slide over the second bay panels, or second rail sections as the first supports posts 100 are laid over during the impact.

The first bay 70 "first" rail sections or panels 20 are attached to the second bay 72 "second" rail sections or panels 20 with the fasteners 60, which are tightened to a predefined torque as described above. The friction force, and corresponding amount of energy dissipation, that resists the first bay rail sections sliding over the second bay rail sections is determined primarily by the clamping torque of the bolts 60.

Figure 8:
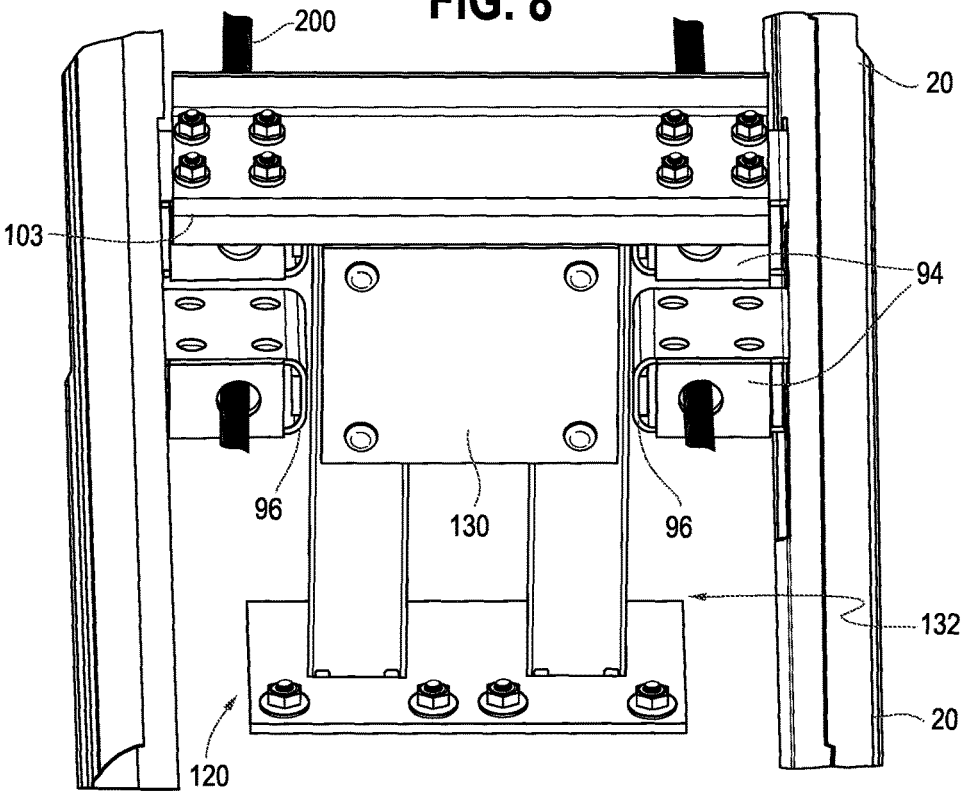
FIG. 8 is a partial, top perspective view of a pair of support posts mounted to rail sections.

The breakaway support posts 100 are welded to ground anchors 150, configured as mounting plates 152, which are bolted to the ground with fasteners 154, for example at a leading portion of the mounting plate 152, and hold up the guardrails, or rail sections, by way of the spacers 94 (FIGS. 8 and 9). A pair of laterally spaced support posts 100 are connected with a laterally extending cross or central web 130, with the support posts 100 and web 130 defining the diaphragm 132. It should be understood that the term "breakaway" refers to the release of the support post 100 from the rail sections 20, but that the support posts preferably remain attached to the ground anchor 150, although it may be released therefrom in some embodiments. The ground anchors 150 may alternatively include a lower post, or spike, which is buried in the ground.

Figure 13A:
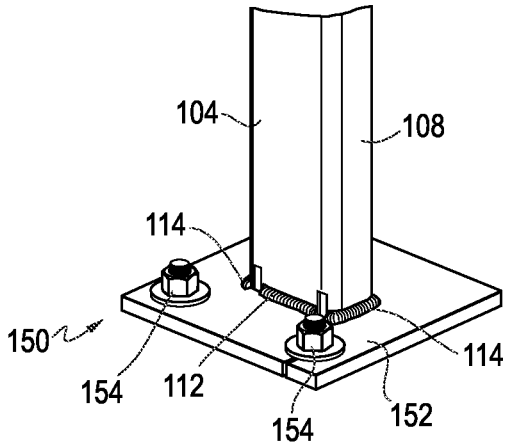
FIG. 13A is a partial perspective view of a support post assembly prior to impact.
Figure 13B:
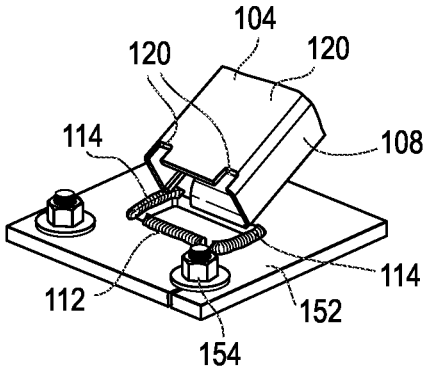
FIG. 13B is a partial perspective view of the support post assembly after impact.
Figure 14A:
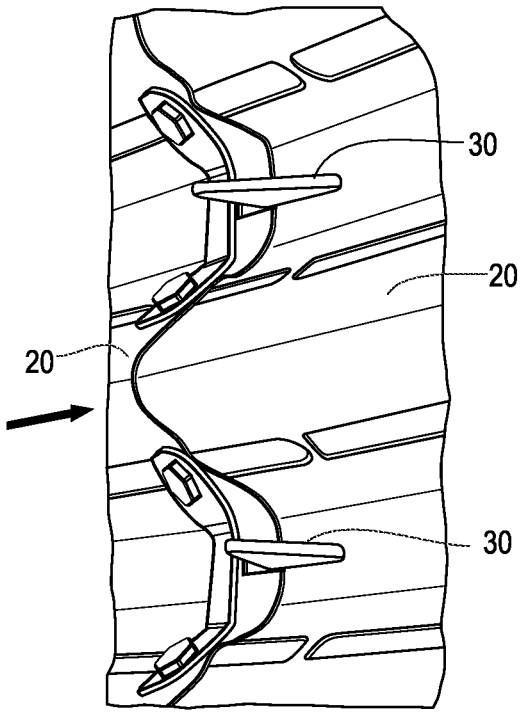
FIG. 14A is a partial perspective view of a rail section with a deforming member underlying another rail section in a pre-impact configuration.
Figure 14B:
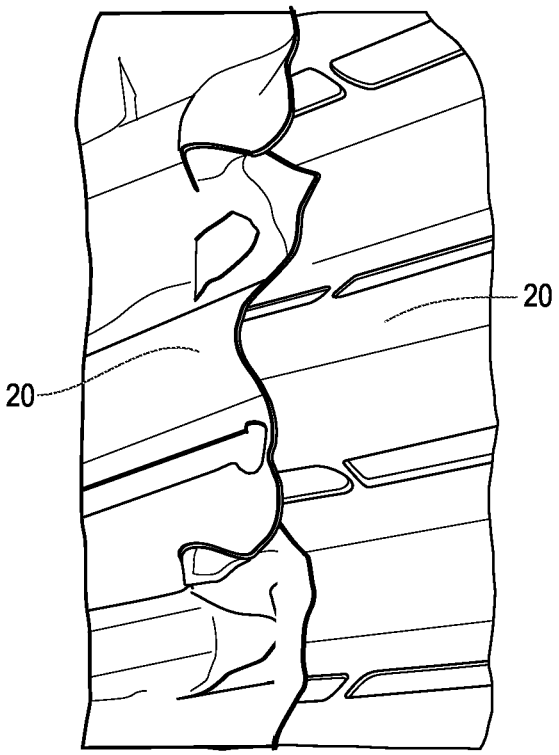
FIG. 14B is a partial perspective view of the rail sections shown in FIG. 14A during an impact event.
Figure 16A:
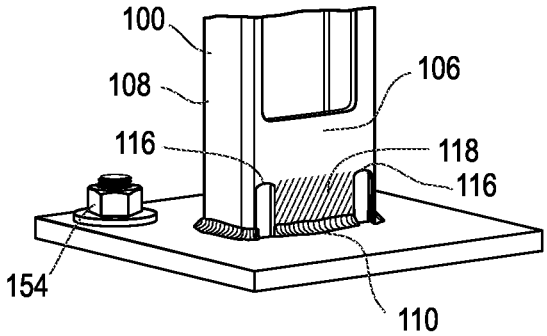
FIG. 16A is a partial rear perspective view of a support post assembly in a pre-impact configuration.
Figure 16B:
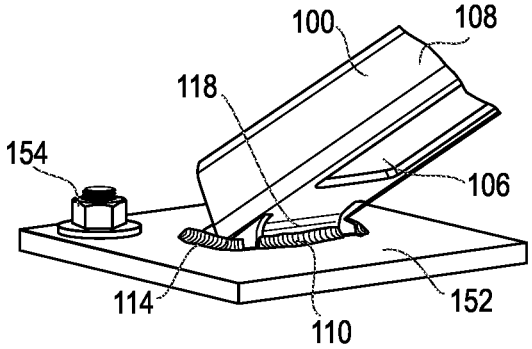
FIG. 16B is a partial rear perspective view of a support post assembly during an impact event as the support post is rotated to a laid over position.

As the first bay 70 of panels, or rail sections, start to slide past the rail sections of the second bay 72, the first pair of support posts 100 rotate over, shearing the shear bolts 96 that attach the support posts to the spacers 94. The cross member 99 remains connected to the upper spacers 94. The support posts 100 are welded to mounting plates 152 in one embodiment (FIGS. 13A, B, 16A and B). The support posts include a front 104, rear 106, and opposite sides 108, with the weld 110 along the rear of the post holding the post to the base. While shown as having a rectangular cross section, it should be understood that the support posts may have a non-rectangular cross section, such as a round cross section, or a C or H shaped cross section, all of which may have a front, sides and a rear. As the breakaway support posts are laid over, the welds 112, 114 at the front and side of the support posts break free (FIGS. 13A, B and 16A, B), or unzip. Vertical slots 116 are added to the rear or back side of each support post so that support post central material, or flange 118, defined between the slots 116 forms a living hinge, and the stress on the weld 110 along the rear is minimized, while also minimizing the possibility that the side welds unzip and propagate to the rear. The bending stress is spaced over a large area of the post material, to lower the chance of the weld 110 material fracturing (FIGS. 13*b* and 16*b*). The vertical slots 116 are added near the edges of each post so the weld of the bending area along the rear will not continue to break as the side welds 114 break. Likewise, slots 120 may be added to the support post on the front to provide discrete breakable welds.

Figure 17:
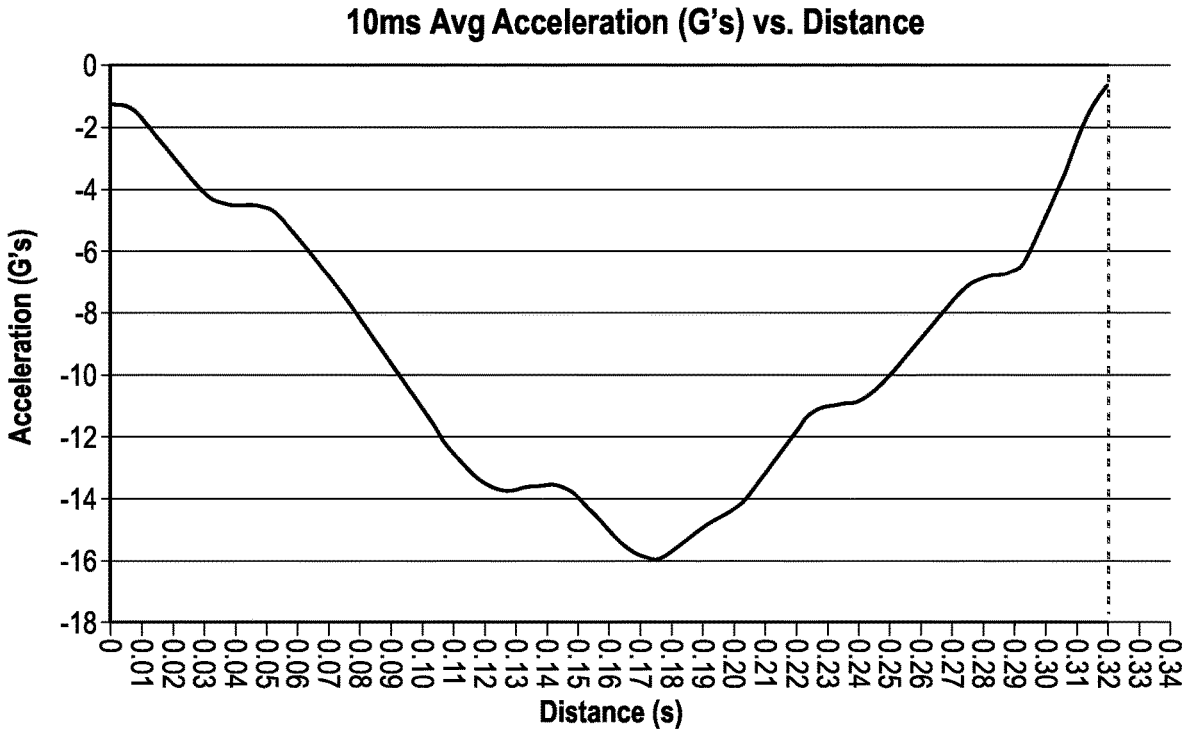
FIG. 17 is a deceleration graph showing the impact response of a pair of support posts (single diaphragm) during impact.
Figure 18:
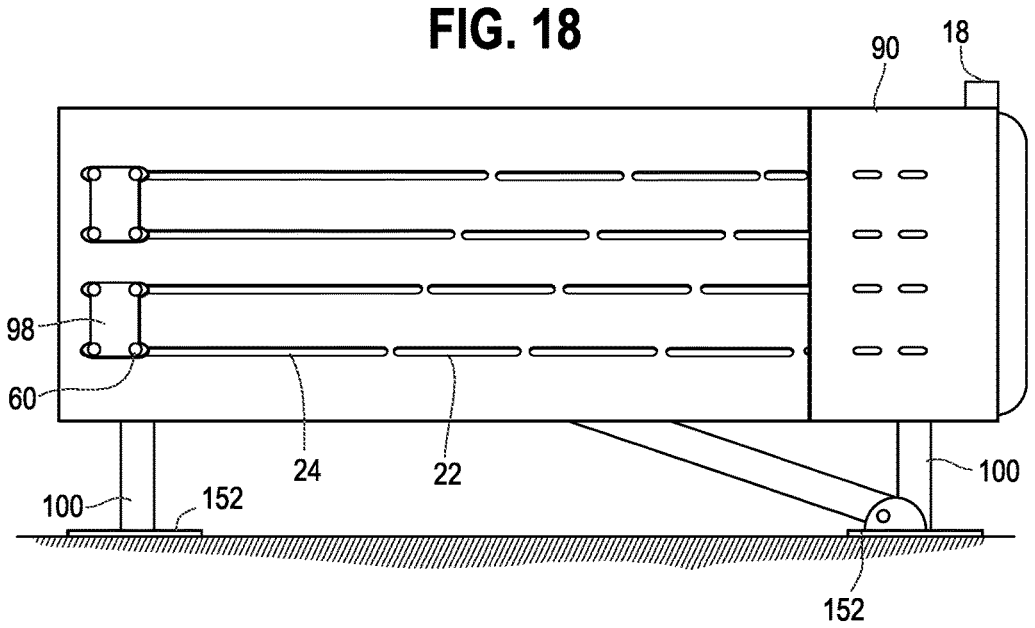
FIG. 18 is side view showing the first bay.

During the impact event, as shown in FIG. 18, the diaphragm 132 and support posts 100 are laid over, defined in one embodiment as the angle at which the diaphragm is no longer absorbing any significant amount of energy. For example, in one embodiment, the diaphragm 132 has laid over once it has tilted over approximately 73 degrees, with the force applied by the diaphragm, or pair of support posts 100 making up at least in part the diaphragm, being substantially reduced at this point as shown in FIG. 17. In order to accommodate the force/energy dissipation during the laying over of the diaphragm, it may be desirable to limit the shearing of tabs 26. In one particular configuration, the minimum length L1 of the first slot(s) is greater than or equal to at least 75% of the first travel distance of the first rail during the laying over of the diaphragm. In one embodiment, the minimum length L1 of the first slot(s) is greater than or equal to the first travel distance of the first rail during the laying over of the diaphragm and support posts. In these systems, in order to accommodate the force/energy dissipation due to a support post being laid over, preferably no tabs 26 are be broken over the travel distance, which is about 0.33 meters in one embodiment as shown in FIG. 17. As shown in FIG. 18, a support post is tipped over by 73° when the panel, or rail section has stroked or moved a travel distance of 0.33 m. In other embodiments, the travel distance or float may be greater than 0.33 m, for example 0.41 m. Extra float, or travel distance, beyond 0.33 m may be provided on the first bay 70 rail sections 20 to further reduce ΔV (difference between occupant and vehicle velocity). The panels, or rail sections 20, in bays 72, 74 and 76 have floats, or travel distances of about 0.35 m each. The panel in the fifth or last bay 78 may have a reduced travel distance, or float (e.g., 0.28 m) because the last bay 78 will only compress if a much heavier vehicle impacts the system. The higher force will not provide as much deceleration on a heavier vehicle.

Referring to FIG. 18, the minimum float is calculated by $\tan \emptyset = X/Z$, or with $X = Z (\tan \emptyset)$, where X, Z and Ø are defined in FIG. 18. In one embodiment, Ø is estimated to be about 73°, which corresponds to the diaphragm, or support posts, being laid over, i.e., energy dissipation is complete as shown in FIG. 17. The length of the float, or travel distance, may vary depending on how much force is required to push over the diaphragm and the geometry of the system. The maximum float, or travel distance, would be calculated with a tipping angle, Ø of up to 89° with a very long post and a Z value slightly more than the thickness of the diaphragm or post.

The bolts 60 that clamp the first rail sections or panels to the second rail sections or panels pass through the slots 24 in the first rail sections. Between the slots there are tabs 26 that are broken to absorb energy and slow down an impacting vehicle. To prevent the force from being too high while the breakaway post is tipping over, the first bay 70 panels or rail sections are designed so that no tabs 26 will be broken while the support post is tipping over. When the spacers that are attached to a stationary second set of support posts/diaphragms are impacted by a moving bay's spacers, the second bay 72 rail sections move along with the impacting vehicle and the same behavior as of the first bay 70 is repeated (FIGS. 11*a* and *b*). The behavior of the second bay 72 sliding over the third bay 74 and subsequent bays follows the same mechanics.

It should be noted that the support posts 100 are connected to the spacers 94 by small shear bolts 96. The spacers are connected to the rail sections with fasteners 60, and with upper pairs of laterally spaced spacers 94 connected with the cross member 99. The small shear bolts 96 connecting the support posts 100 to the spacers 94 are broken very quickly after the head impacts the posts 100 and contribute very little to the resistance of laying the posts over and/or any associated energy dissipation.

A plurality (shown as 2) of vertically spaced slots 142 are also provided in the downstream ends 52 of one or more of the rail sections 20 in the fourth and fifth bays to prevent the deforming member 30, or shaper fin, on the upstream ends 50 of the rail section 20 or short panel 75 in the bays 76, 78 from engaging the upstream rail sections until after the respective support post(s) was laid over. The slots 142 may be formed in the valleys of the rail sections. In one particular configuration, the minimum length of the slots 142 is greater than or equal to at least 75% of the first travel distance of the rail section during the laying over of the diaphragm. In one embodiment, the minimum length of the slot(s) 142 is greater than or equal to the first travel distance of the rail section during the laying over of the diaphragm.

The panels in the fourth bay 76 and the short panel 75 attached to the backup 14 are configured with deforming members 30. As the sliding rail sections 20 from the fourth and fifth bays 76, 78 slide over the next rear non-sliding rail sections, the sliding rail sections are deformed by the deforming members. As such, the impacting vehicle may experience the force/energy dissipation of shearing tabs 26, the force/energy dissipation from the friction of rail sections 20 or panels sliding over one another, the force of the rail sections or panels being deformed by the deforming members 30, and the force of the diaphragms being laid over, with the welds breaking and the living hinge bending. The sum of all these forces, and the energy dissipated by these components, may, if experienced simultaneously, be higher than desired for the impacting vehicle. The sum of forces and energy dissipation may be reduced by modifying the system in such a way that no part of the rail sections will be sheared or deformed by the deforming member while the support posts are laying over. For example, the slot(s) 24, 142 may be elongated as explained above, such that the deforming member 30 does not engage the outboard, sliding panel until a first travel distance has been achieved. In this way, when the outboard rail section slides past the inboard rail section, no initial deformation takes place while the diaphragm is breaking away, or being knocked over/laid over. The length of the slot is determined by analyzing when the diaphragm support posts, connected to the spacers at the impact side of the panel that is sliding, lay over. Once the support post(s) lay over, the sliding rail section or panel may be engaged by the deforming member on the downstream rail section.

The sum of forces, or energy dissipation, may also be reduced by modifying the spacing of the tabs in the guardrail panels, such that no tabs 28, 26 are sheared until the post has nearly lain over. For example as shown in FIG. 6, the first slot 24 is extra-long, such that the first tab is not sheared until the post lays over.

Another feature of the crash cushion is that each of the guardrail panels, or rail sections, may be configured with starter tabs 28 located in the slots 24 that hold downstream panels in place during system collapse. These starter tabs 28 increase the force required to initially move any downstream panels, ensuring that the upstream panels and bays collapse first. For instance, the rail sections in the first bay 70 may not have any starter tabs disposed in the four slots 24. The rail sections in the second and third bays may each have two starter tabs 28, or starter tabs 28 located in two the four elongated slots 24. The rail sections in the fourth bay 76 may have three starter tabs 28 in three of the four slots (see FIG. 6), and the fifth bay 78 may have four starter tabs 28, one in each slot 24 as shown for example in FIG. 7. In this way, each downstream panel requires the same or slightly more force to initiate movement than its adjacent upstream panel, ensuring that the upstream panels collapse before the downstream panels. It should be understood that the length (L1) of the slots 24 are defined from the location of the first upstream fastener 60 to the end of the slot 24, regardless of whether the slot includes a starter tab or not.

The guardrail system may include cables 200 that run the length of the system as shown in FIGS. 2, 3, 8 and 12. The cables are mounted to ground anchors at the front of the system, and then route through the spacers that connect the guardrails panels to the posts. At the back of the system, the cables attach to the system backup. The cables increase the system's ability to redirect vehicles that impact the side of the system and also help to guide the system as it collapses during end-on impacts. The cables can be pre-tightened, for instance by torqueing their threaded ends to a predetermined value.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A crash cushion comprising:

a first rail section comprising an upstream end portion, a downstream end portion and a first side;

a second rail section comprising an upstream end portion, a downstream end portion and a second side facing the first side of the first rail section, wherein the upstream end portion of the second rail section overlaps with and is secured to the downstream end portion of the first rail section with a fastener, and wherein the first rail section is moveable relative to the second rail section from a pre-impact position to an impact position in response to an axial impact to the crash cushion;

wherein the first rail section comprises a plurality of longitudinally spaced slots aligned with and extending upstream of the fastener, wherein the plurality of slots comprises a first elongated slot aligned with the fastener when the first rail section is in the pre-impact position, wherein the first elongated slot has a first length; and a support post releasably connected to the first rail section and rotatable from an upright position to a laid over position, wherein the support post is releasable from the first rail section and is rotatable to the laid over position after the first rail section has moved a first travel distance during the axial impact, wherein the first length is greater than or equal to at least 75% of the first travel distance.

2. The crash cushion of claim 1 wherein the second rail section comprises a deforming member secured to the upstream end portion thereof, and wherein the first rail section has a second elongated slot aligned with the deforming member, wherein the second elongated slot has a second length greater than or equal to at least 75% of the first travel distance.

3. The crash cushion of claim 1 wherein the first rail section comprises a plurality of vertically spaced second elongated slots, and wherein the second rail section comprises a plurality of vertically spaced deforming members aligned with the vertically spaced second elongated slots.

4. The crash cushion of claim 3 wherein the plurality of vertically spaced second elongated slots comprises two vertically spaced second elongated slots and wherein the plurality of vertically spaced deforming members comprises two vertically spaced deforming members.

5. The crash cushion of claim 1 wherein the first rail section comprises a plurality of vertically spaced rows of the plurality of longitudinally spaced slots, wherein each of the rows of the plurality of slots includes the first elongated slot, and further comprising a plurality of vertically spaced fasteners aligned with the first elongated slots of the vertically spaced rows and securing the first and second rail sections.

6. The crash cushion of claim 5 wherein the plurality of vertically spaced rows comprises four rows.

7. The crash cushion of claim 5 wherein at least one of the first elongated slots comprises a starter tab extending across the first elongated slot, wherein the at least one of the first elongated slots is shorter than at least another one of the first elongated slots.

8. The crash cushion of claim 1 where in the support post is releasably coupled to a spacer with a shear fastener, wherein the spacer is coupled to the second rail section.

9. The crash cushion of claim 1 further comprising a ground anchor coupled to the support post, wherein the support post has a front, a rear and opposite sides, wherein the rear comprises a pair of vertical slots and a hinge portion defined between the slots, wherein a bottom of the hinge portion and at least one of the front and sides are connected to the ground anchor with welds, wherein the welds connecting the at least one of the front and sides are breakable as the support post is rotatable about the hinge portion from the upright position to the laid over position.

10. The crash cushion of claim 9 wherein the support post has a rectangular cross-section.

11. The crash cushion of claim 10 wherein the front comprises a second pair of vertical slots and a fuse portion defined between the second pair of slots, wherein one of the welds connects the bottom of the fuse portion to the ground anchor.

12. The crash cushion of claim 9 wherein the ground anchor comprises an anchor plate.

13. The crash cushion of claim 1 comprising a pair of laterally spaced first rail sections, a pair of laterally spaced second rail sections secured to the first rail sections, and a pair of laterally spaced support posts releasably coupled to the first rail sections.

14. The crash cushion of claim 13 wherein the pair of laterally spaced support posts are connected to define a diaphragm.

15. The crash cushion of claim 1 further comprising a ground anchor coupled to the support post, wherein the support post remains coupled to the ground anchor after the support post is released from the first rail section and is rotated to the laid over position.

16. A crash cushion comprising:

a first rail section comprising an upstream end portion, a downstream end portion and a first side;

a second rail section comprising an upstream end portion, a downstream end portion and a second side, wherein the upstream end portion of the second rail section overlaps with and is secured to the downstream end portion of the first rail section with a fastener wherein the first and second sides face each other, and wherein the first rail section is moveable relative to the second rail section from a pre-impact position to an impact position in response to an axial impact to the crash cushion;

a support post releasably connected to the first rail section and rotatable from an upright position to a laid over position as the first rail section is moved from the pre-impact position to the impact position, wherein the support post absorbs a first amount of energy as it is rotated to the laid over position and is released from the first rail section; and wherein the first rail section comprises a plurality of longitudinally spaced slots aligned with and extending upstream of the fastener, wherein a first adjacent pair of slots are separated by a tab, wherein the fastener engages the tab and absorbs a second amount of energy after the support post absorbs at least 75% of the first amount of energy.

17. The crash cushion of claim 16 wherein the second rail section comprises a deforming member secured to the upstream end portion thereof, and wherein the first rail section has a second elongated slot aligned with the deforming member, wherein the deforming member is engageable with the first rail section at an end of the second elongated slot and absorbs a third amount of energy after the support post absorbs at least 75% of the first amount of energy.

18. The crash cushion of claim 16 wherein the first rail section comprises a plurality of vertically spaced second elongated slots, and wherein the second rail section comprises a plurality of vertically spaced deforming members aligned with the vertically spaced second elongated slots.

19. The crash cushion of claim 18 wherein the plurality of vertically spaced second elongated slots comprises two vertically spaced second elongated slots and wherein the plurality of vertically spaced deforming members comprises two vertically spaced deforming members.

20. The crash cushion of claim 16 wherein the first rail section comprises a plurality of vertically spaced rows of the plurality of longitudinally spaced slots, wherein each of the rows of the plurality of slots includes the first elongated slot, and further comprising a plurality of vertically spaced fasteners aligned with the first elongated slots of the vertically spaced rows and securing the first and second rail sections.

21. The crash cushion of claim 20 wherein the plurality of vertically spaced rows comprises four rows.

22. The crash cushion of claim 20 wherein at least one of the first elongated slots comprises a starter tab extending across the first elongated slot, wherein the at least one of the first elongated slots is shorter than at least another one of the first elongated slots.

23. The crash cushion of claim 16 where in the support post is releasably coupled to a spacer with a shear fastener, wherein the spacer is coupled to the second rail section.

24. The crash cushion of claim 16 further comprising a ground anchor coupled to the support post, wherein the support post has a front, a rear and opposite sides, wherein the rear comprises a pair of vertical slots and a hinge portion defined between the slots, wherein a bottom of the hinge portion and at least one of the front and sides are connected to the ground anchor with welds, wherein the welds connecting the at least one of the front and sides are breakable as the support post is rotatable about the hinge portion from the upright position to the laid over position.

25. The crash cushion of claim 24 wherein the support post has a rectangular cross-section.

26. The crash cushion of claim 24 wherein the front comprises a second pair of vertical slots and a fuse portion defined between the second pair of slots, wherein one of the welds connects the bottom of the fuse portion to the ground anchor.

27. The crash cushion of claim 24 wherein the ground anchor comprises an anchor plate.

28. The crash cushion of claim 16 comprising a pair of laterally spaced first rail sections, a pair of laterally spaced second rail sections secured to the first rail sections, and a pair of laterally spaced support posts releasably coupled to the first rail sections.

29. The crash cushion of claim 28 wherein the pair of laterally spaced support posts are connected.

30. The crash cushion of claim 16 further comprising a ground anchor coupled to the support post, wherein the support post remains coupled to the ground anchor after the support post is released from the first rail section and is rotated to the laid over position.

* * * * *